US011781279B1

(12) United States Patent
Parr et al.

(10) Patent No.: US 11,781,279 B1
(45) Date of Patent: Oct. 10, 2023

(54) PILE CONNECTION DEVICES AND METHODS THEREOF

(71) Applicant: FASTENERS DIRECT CORPORATION, Webster, NY (US)

(72) Inventors: Timothy H. Parr, Webster, NY (US); Thomas E. Chellberg, Lakeville, MN (US)

(73) Assignee: FASTENERS DIRECT CORPORATION, Webster, NY (US)

( * ) Notice: Subject to any disclaimer, the term of this patent is extended or adjusted under 35 U.S.C. 154(b) by 0 days.

(21) Appl. No.: 18/094,705

(22) Filed: Jan. 9, 2023

(51) Int. Cl.
*E02D 5/52* (2006.01)
*F16B 13/06* (2006.01)
*F16B 19/10* (2006.01)

(52) U.S. Cl.
CPC ..... *E02D 5/526* (2013.01); *E02D 2600/20* (2013.01)

(58) Field of Classification Search
CPC ... E02D 5/526; E02D 2600/20; E21B 17/046; E21B 17/0465; F16B 7/042; F16B 29/00; F16B 39/284; F16B 2037/007; F16B 37/067; F16B 19/1072
See application file for complete search history.

(56) References Cited

U.S. PATENT DOCUMENTS 3,017,800 A * 1/1962 Cohen ..... F16B 13/061 411/34
5,074,726 A * 12/1991 Betchel ..... F16B 19/1072 411/34
2005/0100416 A1* 5/2005 Whitsett ..... E02D 5/72 405/233

FOREIGN PATENT DOCUMENTS

DE 102007051778 A1 * 5/2009 ..... E05D 5/023
GB 1391864 A * 4/1975 ..... D01D 10/0445

* cited by examiner

*Primary Examiner* — Benjamin F Fiorello
*Assistant Examiner* — Stacy N Lawson
(74) *Attorney, Agent, or Firm* — Troutman Pepper Hamilton Sanders LLP (Rochester)

(57) ABSTRACT

Pile connection methods and devices are disclosed. In some examples, a pile connection device includes a plug including a head, a body extending from a distal end of the head, a first bolt aperture extending through the head and the body and configured to receive a bolt, and pins extending from a distal end of the body. The pile connection device further includes a nut including pin apertures each configured to receive one of the pins, projections extending from a circumference of a proximal end of the nut, and a second bolt aperture that is threaded and configured to align with the first bolt aperture when the pins are received by the pin apertures. The second bolt aperture is configured to receive a threaded distal portion of the bolt to thereby draw the nut toward the plug and retain the pile connection device within apertures in the connected piles.

17 Claims, 9 Drawing Sheets

PILE CONNECTION DEVICES AND METHODS THEREOF

FIELD

This technology generally relates to pile or pier foundation systems and, more particularly, to pile connection devices with reduced material utilization and improved structural integrity and ease of installation, among other advantages.

BACKGROUND

A deep structural foundation can be formed via a series of columns, tubes, cylinders, piers, posts, poles, shafts, pipes, or hollow sections, for example, which are commonly referred to herein as "piles," that are coupled together and inserted into the ground to facilitate transmission of structural loads to a lower level of subsoil. Since the insertion is generally via a rotational action, at least in part, the piles are often referred to as screw, rotary, or helical piles. Thus, such piles are often relatively long, hollow structures made of a relatively strong material, such as steel, which transfer the loads from structures to hard strata, rocks, or soil with relatively high bearing capacity. Piles support structures by remaining solidly placed in the soil, and thus are deep foundation solutions used to secure new, or repair existing, foundations, often for large structures, including bridges, skyscrapers, and other applications having concentrated loads built at an area of relatively weak soil or high water table, for example.

To install a pile foundation, piles are hammered, driven, and/or screwed into the ground (e.g., using a pile driver) to a desired depth, optionally until a refusal point is reached, which is the point where a pile cannot be driven into the soil any farther. Accordingly, piles can be without exterior surface features and/or helical piles, often referred to as screw piles, with helical features that are rotated during insertion. While many different types of piles can be used depending on application site and tolerances, among other considerations, piles are often connected such that a proximal end of an inserted pile is coupled to a distal end of another pile, which is itself inserted into the ground, and the process continues until the set of piles has reached a desired depth for the foundation.

Referring to FIG. 1, a top view of a prior art pile connection system 100 is illustrated. In this example, the distal end 102 of an upper or first pile 104 is sized to extend over a portion of a proximal end 106 of a lower or second pile 108 such that two apertures in each of the first pile 104 and second pile 108 are in alignment on opposing sides of the first pile 104 and second pile 108. A relatively large, typically steel, threaded bolt 110 is then inserted through the apertures on both sides of both the first pile 104 and second pile 108 and retained in place via nut(s) 112A-B, for example. This pile connection system 100 has several significant drawbacks.

The installation of the bolt 110 requires the alignment of four apertures, including two each on opposing sides of the first pile 104 and second pile 108, which can be very difficult and time-consuming with such large structures. Often, multiple sets of opposing apertures and bolts of multiple pile connection systems are utilized for each pile connection, thereby increasing the installation challenge. Once installed, threads of the bolt 110 of the pile connection system 100 remain in the shear plane of the two connected piles (i.e., the first pile 104 and second pile 108), which is undesirable and can lead to structural weakness and/or failure. Additionally, the bolt 110 of the prior art pile connection system 100 extends across the entire diameter of the two connected piles (i.e., the first pile 104 and second pile 108), thereby requiring a large amount of material and resulting in substantial cost and weight, among other disadvantages.

SUMMARY

In one example, a pile connection device is disclosed that includes a plug including a plug head, a plug body extending from a first distal end of the plug head, a first bolt aperture extending through the plug head and the plug body and configured to receive a bolt, and at least two pins extending from a second distal end of the plug body. In this example, the plug head is wider than the plug body. The pile connection device also includes a nut including at least two pin apertures each configured to receive one of the pins, a plurality of projections extending from at least a portion of a circumference of a first proximal end of the nut, and a second bolt aperture that is threaded and configured to align with the first bolt aperture when the pins are received by the pin apertures. The second bolt aperture is configured to receive a threaded distal portion of the bolt to thereby draw the nut toward the plug.

In another example, a pile connection device is disclosed that includes a plug including a plug head, a plug body extending from a first distal end of the plug head, a first bolt aperture extending through the plug head and the plug body and configured to receive a bolt, and at least two pins extending from a second distal end of the plug body. The plug head is wider than the plug body in this example. Additionally, the pile connection device in this example includes a nut including at least two pin apertures each configured to receive one of the pins, a plurality of projections extending from at least a portion of a circumference of a first proximal end of the nut, and a second bolt aperture that is threaded and configured to align with the first bolt aperture when the pins are received by the pin apertures. The second bolt aperture is configured to receive a threaded distal portion of the bolt to thereby draw the nut toward the plug.

In one aspect of this example, the plug body is configured to be inserted into aligned first and second pile apertures in first and second piles, respectively, and has a plug body thickness that is at least as thick as a combined thickness of first and second walls of the first and second piles, respectively. In another aspect of this example, at least a portion of a proximal end of the washer is configured to engage an inner portion of the first pile to thereby retain the plug within the aligned first and second pile apertures, when the plug body is inserted into the aligned first and second pile apertures, the threaded distal portion of the bolt is received by the second bolt aperture, and the nut is drawn toward the plug. In yet other aspects of this example the washer includes a rubber material and, when compressed, is wider than the plug body, a third distal end of the nut is narrower than a proximal end of the nut, and/or the plug body further comprises at least two pin cavities disposed proximate the second distal end of the plug body and each configured to receive a third portion of one of the pins via a press fit.

In yet another example, a method for connecting piles is disclosed that includes providing a pile connection device and inserting the pile connection device into a first pile aperture of a first pile and an aligned second pile aperture of a second pile such that a first portion of a first distal end of the plug head is disposed proximate a second portion of an outer wall of the first pile. A third portion of the threaded distal portion of the bolt is then threaded within the threaded second bolt aperture to thereby draw the nut toward the plug body at least until the projections contact an inner portion of the second pile.

With the pile connection devices of this technology, piles can be connected with reduced installation time and using significantly less material (e.g., 75% less steel in an 18 inch diameter pile with a 2 inch steel bolt), resulting in lower cost. This technology requires half the pile apertures to be aligned for each installation as compared to prior art pile connection systems and does not require any material to extend across the entire diameter of the piles. When installed, the pile connection devices of this technology exhibit minimal drag and do not require any threads to be in any portion of the shear plane, resulting in increased strength and durability.

DETAILED DESCRIPTION

Figure 2:
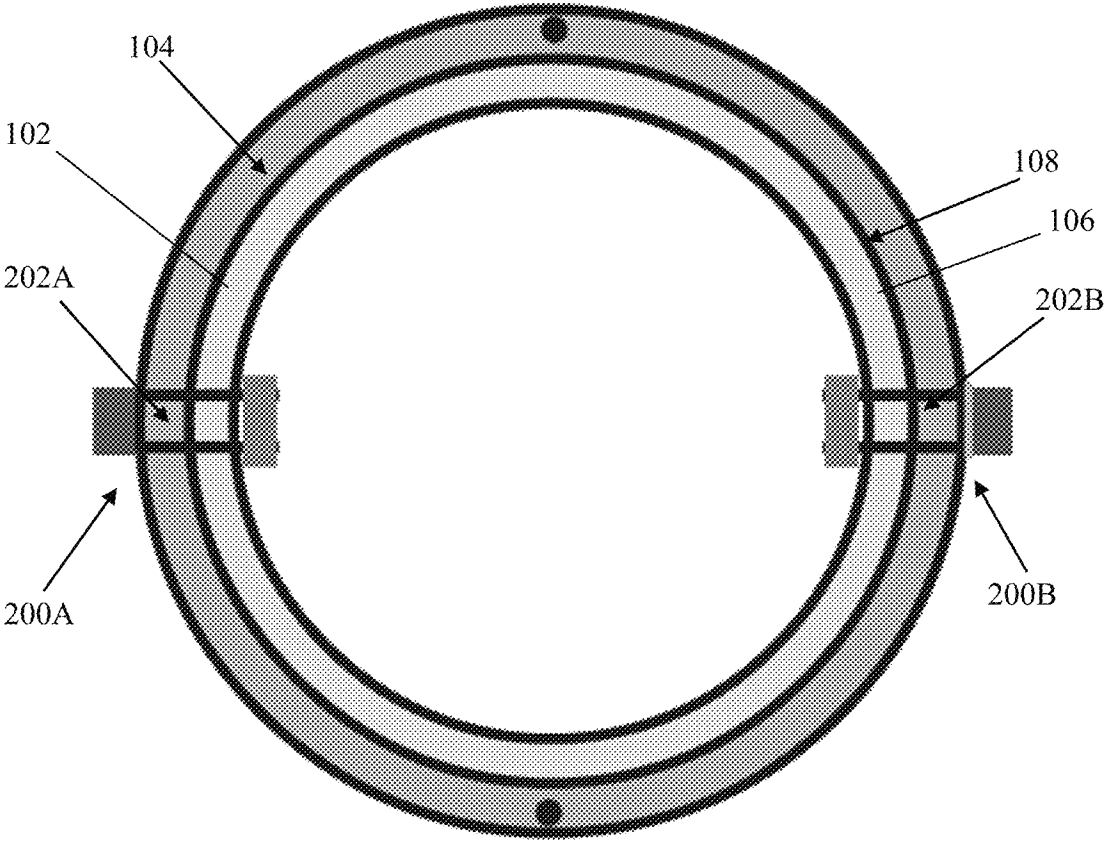
FIG. 2 is a top view of first and second piles coupled together by exemplary pile connection devices.

Referring to FIG. 2, a top plan view of the first pile 104 and the second pile 108 coupled together by exemplary pile connection devices 200A-B is illustrated. In this particular example, the first pile 104 has a larger circumference at its distal end than a circumference of the second pile 108 at its proximal end, although this configuration could also be reversed in other examples. Thus, in this example, the first pile 104 extends beyond the proximal end of the second pile 108 to facilitate alignment of opposing sets of pile apertures 202A-B. In FIG. 2, the pile connection devices 200A-B are inserted into the sets of pile apertures 202A-B to retain the first pile 104 and the second pile 108 in place relative to one another. One or both of the pile connection devices 200A-B can be the exemplary pile connection device 300 or the exemplary pile connection device 700 described and illustrated in detail herein with reference to FIGS. 3-6 and 7-10, respectively.

Figure 1:
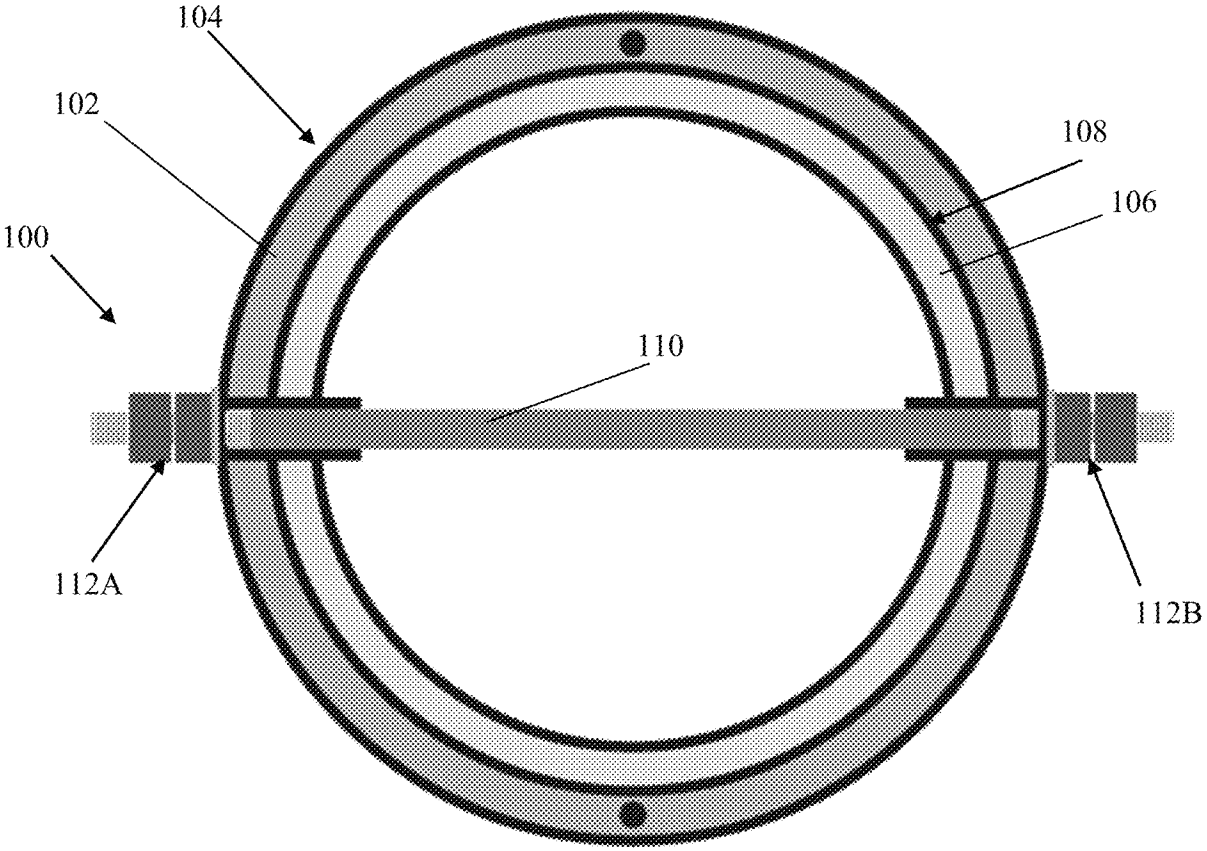
FIG. 1 (Prior Art)
FIG. 1 is a top plan view of a prior art pile connection system.

While the first pile 104 and the second pile 108 are the same as in the prior art pile connection system 100 of FIG. 1, the pile connection devices 200A-B of this technology require significantly less material when installed via the sets of pile apertures 202A-B to retain the first pile 104 and the second pile 108 in place relative to one another. Additionally, each of the pile connection devices 200A-B is inserted independently and therefore installation of each of the pile connection devices 200A-B requires aligning two apertures of one of the sets of pile apertures 202A-B (i.e., one for each of the first pile 104 and the second pile 108) as compared to the four apertures of both of the sets of pile apertures 202A-B (i.e., two apertures for each of the first pile 104 and the second pile 108) required by the unitary structure (i.e., bolt 110) of the prior art pile connection system 100.

Accordingly, the installation of the technology disclosed herein is significantly easier and quicker than that of the prior art pile connection system 100. As will be described and illustrated in more detail below, the pile connection devices 200A-B also do not have any threads in the shear plane when installed via the sets of pile apertures 202A-B and are therefore stronger and more durable than the prior art pile connection system 100.

Figure 3:
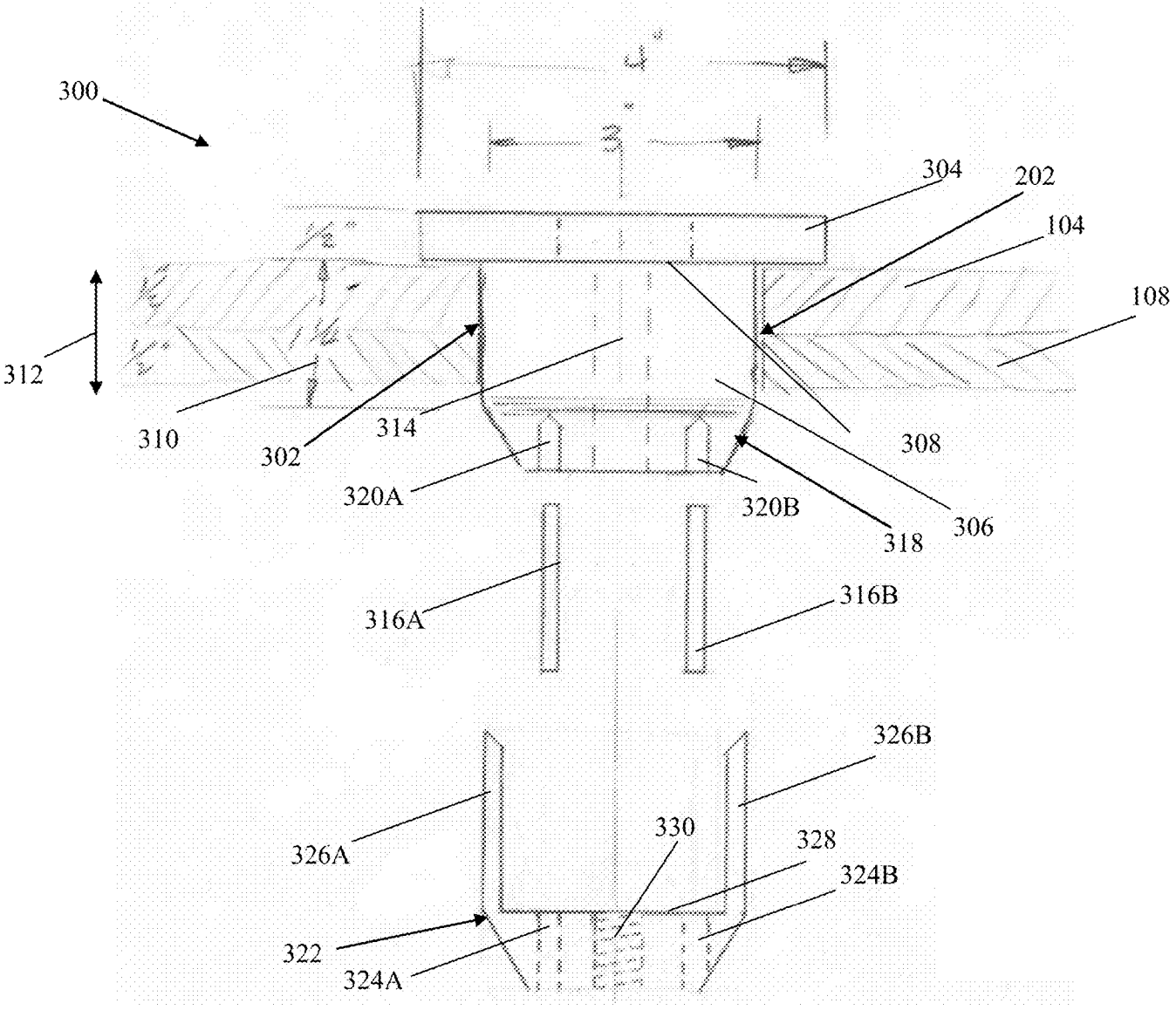
FIG. 3 illustrates of an exemplary pile connection device that is in a disassembled configuration and includes a plug inserted into pile apertures.

Referring now to FIG. 3, an exemplary pile connection device 300 that is in a disassembled configuration and includes a plug 302 inserted into aligned set of pile apertures 202 is illustrated. In this example, the plug 302 includes a plug head 304 and a plug body 306 that extends from a distal end 308 of the plug head 304. In one example, the plug head 304 has a hexagonal shape and the plug body 306 has a cylindrical shape matching the round profile of the set of pile apertures 202, although other shapes can also be used.

Irrespective of the plug head 304 shape, at least a portion of the plug head 304 is wider than the plug body 306 and the set of pile apertures 202 to prevent the plug head from entering the set of pile apertures 202. In the particular example illustrated in FIG. 3, the pile apertures 202 have a diameter of approximately three inches, the plug body 306 has a diameter of slightly less than three inches such that the plug body 306 is capable of insertion into the pile apertures 202, and the plug head 304 has a width of four inches, although any width of the plug head 304 greater than three inches could also be used in this example, and other dimensions for any of these elements can also be used in other examples.

The plug body 306 in this example has a thickness 310 that is at least as thick as a combined thickness 312 of walls of the first and second piles 104 and 108, respectively. In this particular example, the plug body thickness 310 (through a proximal portion of the plug body 306 having a uniform thickness) is 1.25 inches and each of the walls of the first and second piles 104 and 108, respectively, is 0.5 inches thick for a combined thickness 312 of one inch, which is less than the 1.25 inches of the plug body thickness 310. In other examples, other dimensions and thicknesses can be used. In some examples, the plug body 306 has a substantially smooth exterior surface through the portion of the plug body 306 that is at least as thick as the combined thickness 312 of the walls of the first and second piles 104 and 108, respectively. The weight of at least a portion of one of the first or second piles 104 or 108, respectively, is supported on the plug body 306 forming a shear plane, which advantageously does not include any threads with this technology.

The plug 302 also includes a bolt aperture 314 in this example, which extends through the plug head 304 and the plug body 306. The plug bolt aperture 314 in this particular example is wider through the plug head 304 than through the plug body 306 such that the plug bolt aperture 314 can accommodate a bolt head at the plug head 304 to facilitate an optional flush fit of a bolt, although the plug bolt aperture 314 can have a uniform diameter throughout the plug 302 and other configurations can also be used in other examples. Accordingly, the plug bolt aperture 314 is sized to accommodate at least a shaft of a desired bolt to be utilized with the pile connection device 300, as described and illustrated in more detail below.

The plug 302 also includes two pins 316A-B extending from a distal end 318 of the plug body 306, although more than two pins can also be used in other examples. The pins in this example are substantially cylindrical in shape (e.g., 5/16 of an inch diameter dowels), although other shapes can also be used for the pins 316A-B in other examples. In this particular example, the plug body 306 includes two pin cavities 320A-B disposed proximate the plug body distal end 318. Each of the pin cavities 320A-B is configured and sized to receive a portion of one the pins 316A-B via a press fit. In other examples, the pins 316A-B can be threaded into the pin cavities 320A-B and, in yet other examples, the pins 316A-B can be integral with the plug body 306 and/or the pins 316A-B, plug body 306, and/or plug head 304 can be formed as an monolithic unit. Other configurations for the pins 316A-B can also be used in other examples.

The pile connection device 300 further includes a nut 322 including two pin apertures 324A-B, which are configured and sized to receive the pins 316A-B, respectively, although another number of pin apertures corresponding to another number of pins can also be used in other examples. The nut 322 includes a plurality of projections 326A-B extending from at least a portion of a circumference of a proximal end 328 of the nut 322. While two projections 326A-B are illustrated in FIG. 3 according to the view illustrated therein, in some examples, the projections are spaced apart and extend around a portion or an entirety of the circumference of the nut proximal end 328, disposed toward an outer or exterior portion of the nut 322, as will be described and illustrated in more detail below with reference to FIG. 6.

In this example, the nut 322 includes a bolt aperture 330 that is threaded and configured to align with the plug bolt aperture 314 when the pins 316A-B are received by the pin apertures 324A-B. The nut bolt aperture 330 is configured to receive a threaded distal portion of a bolt that is inserted through the plug bolt aperture 314 to thereby draw the nut 322 toward the plug 302, as will be explained and illustrated in more detail below with reference to FIGS. 4-5. In some examples, the plug 302 and/or the nut 322 can be made of steel (e.g., stainless steel), although other metals and/or other types of materials can also be used in other examples.

Figure 4:
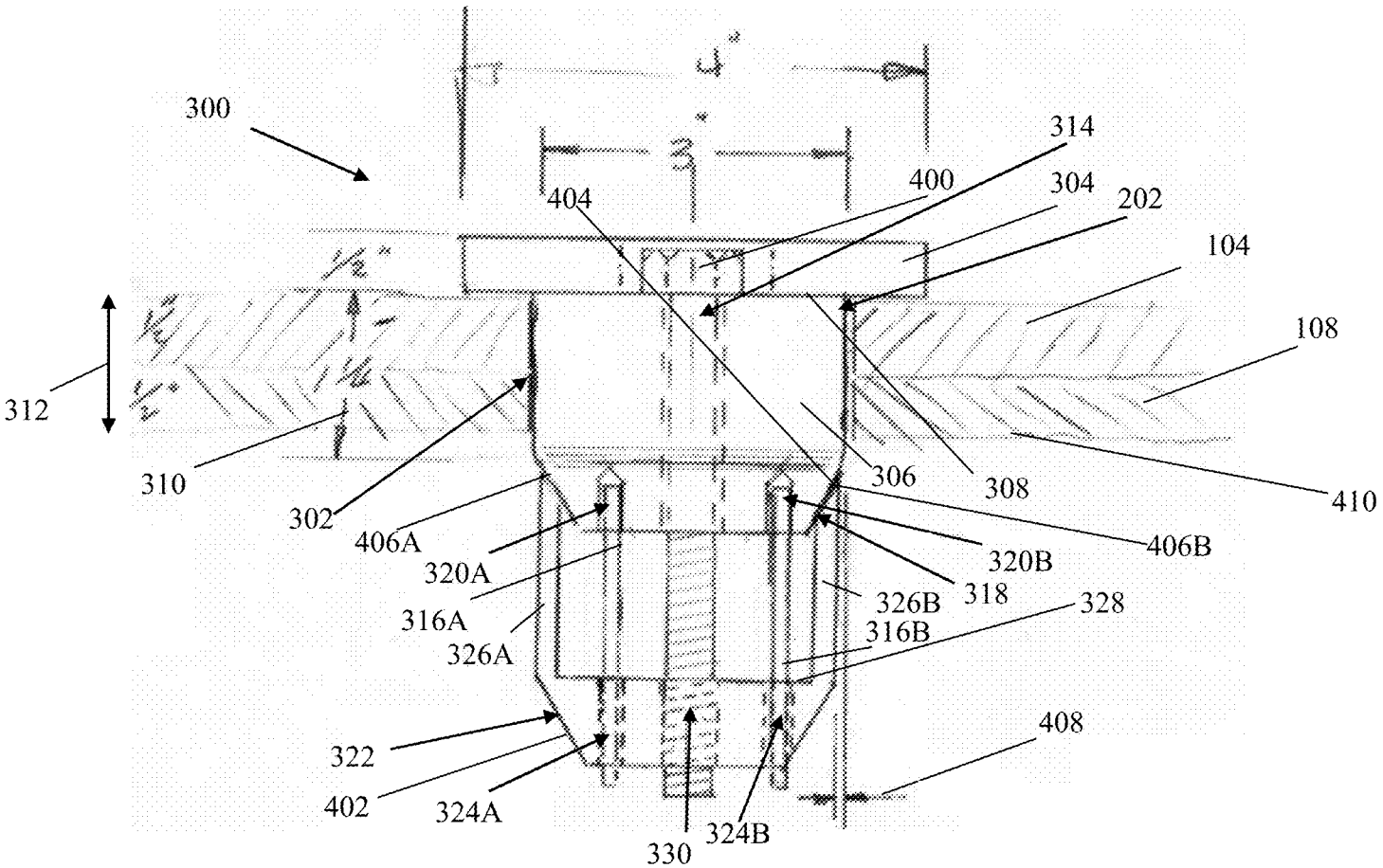
FIG. 4 illustrates the pile connection device of FIG. 3 in an assembled configuration with the plug inserted into the pile apertures but before tightening the bolt to complete installation.

Referring to FIG. 4, the pile connection device 300 in an assembled configuration with the plug 302 inserted into the set of pile apertures 202A-B but before tightening the bolt 400 to complete installation is illustrated. In this assembled configuration, proximal portions of the pins 316A-B are press fit into the pin cavities 320A-B, respectively, and the bolt 400 (e.g., a 5/8 of an inch diameter, 18 thread size, grade 8 bolt) is inserted into the plug bolt aperture 314 and a distal portion of the bolt 400 is threaded into the nut bolt aperture 330 to draw the nut 322 toward the plug body 306 while distal portions of the pins 316A-B are received by the pin apertures 324A-B.

Since the pins 316A-B are stationary once press fit in this particular example, the nut 322 is prevented from rotating as a result of the threading of the bolt 400 into the nut bolt aperture 330 once the pins 316A-B are at least partially received by the pin apertures 324A-B, respectively. Optionally, the pile connection device 300 can be in the assembled configuration illustrated in FIG. 4 upon insertion of the pile connection device 300 into the set of pile apertures 202. Accordingly, the a distal end of the nut 322 optionally includes a beveled portion 402 that aids insertion of the pile connection device 300 into the set of pile apertures 202. Thus, in this example, the distal end of the nut 322 is narrower than the nut proximal end 328 as a result of the nut beveled portion 404.

In this example, the plug body distal end 318 optionally includes a beveled portion 404 and each of the projections 326A-B includes a proximal end 406A-B, respectively, that is angled to match an opposing angle of the plug body beveled portion 404. Accordingly, the projections 326A-B are configured to contact or engage the plug body beveled portion 404 as the threaded distal portion of the bolt 400 is received by the nut bolt aperture 330 and the nut 322 is drawn toward the plug 302. Optionally, the plug body 306 is wider than the nut 322 (e.g., by 1/8 of an inch) creating a gap 408, although in other examples the plug body 306 and the nut 322 can have the same width or the nut 322 can be wider than the plug body 306 as long as the projections 326A-B contact the plug body distal end 318 (e.g., at the plug body beveled portion 402) as the nut 322 is drawn toward the plug 302.

As the nut 322 is drawn toward the plug 302, the engagement of the angled projection proximal ends 406A-B with the plug body beveled portion 404 in this example will cause the projections 326A-B to expand outward beyond the plug body 306 and toward the inner wall 410 of the second pile 108. Accordingly, the projections 326A-B effectively bend at the nut proximal end 328 when forced to expand outward by the engagement of the angled projection proximal ends 406A-B with the plug body beveled portion 404. While both the plug body 306 and the projections 326A-B have opposing angled or beveled ends in this example, in other examples only one of the plug body 306 or the projections 326A-B can have an angled or beveled end, and other configurations that result in outward expansion of the projections 326A-B when the projections interface or engage the plug body 306 can also be used.

Figure 5:
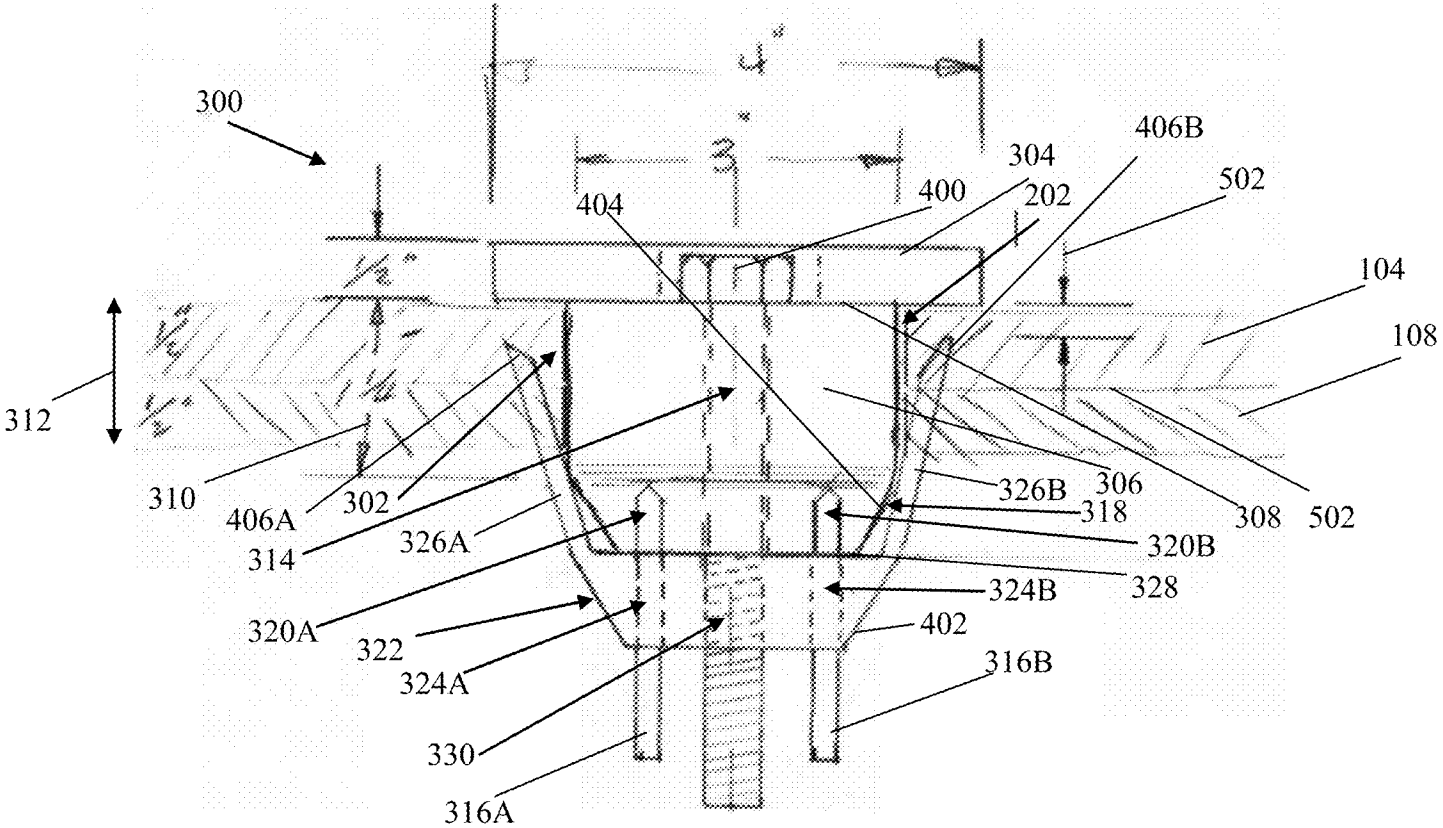
FIG. 5 illustrates the pile connection device of FIG. 3 in an installed configuration with the bolt tightened and nut projections contacting an inner wall of one of the piles to retain the pile connection device in place.

Referring to FIG. 5, the pile connection device 300 in an installed configuration with the bolt 400 tightened and projections 326A-B contacting the inner wall 410 of the second pile 108 to retain the pile connection device 300 in place is illustrated. Subsequent to insertion of the pile connection device 300 into the set of pile apertures 202 as described and with reference to FIG. 4, the bolt 400 is further threaded into the nut bolt aperture 330. As the nut 322 is drawn further toward the plug 302, the projections 326A-B are configured to contact or engage an inner portion (e.g., the inner wall 410) of the second pile 108.

Upon engagement with the second pile 108, the projections 326A-B may crumple, crush, or continue to expand outward until the nut proximal end 328 contacts the plug body distal end 318. Irrespective of the reaction, if any, by the projections 326A-B following contact with the second pile 108, the projections 326A-B will be spaced apart sufficiently far to prevent the nut 322, and any other portion of the pile connection device 300, from moving in a rearward direction back through the set of pile apertures 202. In other words, the pile connection device 300 will thereafter retain the first pile 104 and the second pile 108 in place relative to one another.

In the example illustrated in FIG. 5, the projections 326A-B are shown as protruding beyond the second pile inner wall 410 and an inner wall 500 of the first pile merely to illustrate that, with the configuration and dimensions of the pile connection device 300 of FIG. 5, the first and second piles 104 and 108, respectively, could have a minimum combined thickness 502 smaller than the combined thickness 312 of the exemplary illustrated first and second piles 104 and 108, respectively. Accordingly, the exemplary pile connection device 300 could be modified in any number of ways (e.g., projection length, plug body length, or nut length) to accommodate different parameters (e.g., particular pile thicknesses or pile aperture diameter) depending on the desired application of the pile connection device 300.

Figure 6:
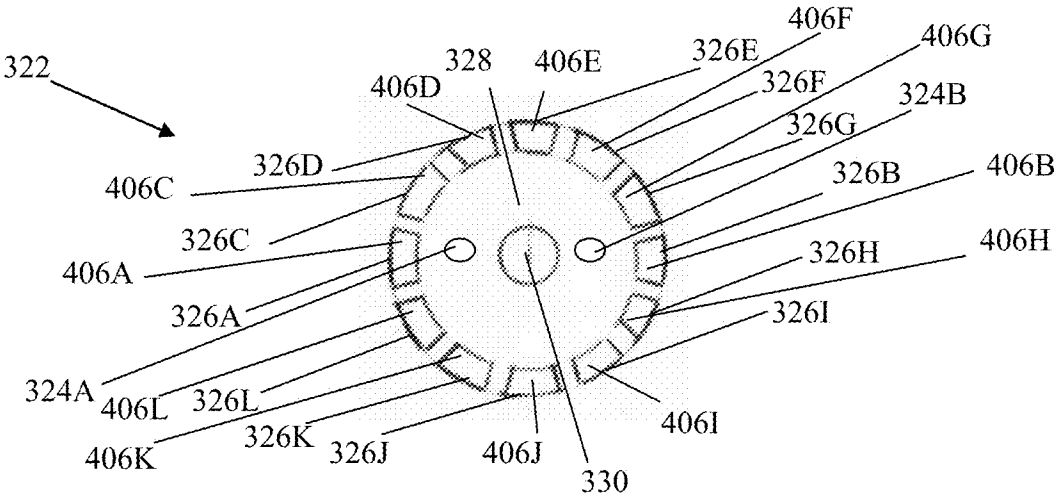
FIG. 6 is a top plan view of an exemplary nut of the pile connection device of FIG. 3.

Referring now to FIG. 6, a top plan view of the nut 322 of the pile connection device 300 is illustrated. In this example, projections 326A-L are illustrated, which are located around the entirety of the circumference of the nut 322 toward an outer perimeter or edge and include proximal ends 406A-L, respectively. Accordingly, the projections 326A-L in this particular example are spaced from each other and disposed around an entirety of the circumference of an outer portion of the nut proximal end 328. However, in other examples, more or fewer projections can be utilized, the projections can be smaller or larger, and/or the projections can be disposed around less of the circumference and/or in a different location, and other configurations for the projections can also be used. Optionally, the projections 326A-L can be formed via saw cutting of slots between each of the projections 326A-L, although other methods of forming the projections 326A-L can also be used.

Figure 7:
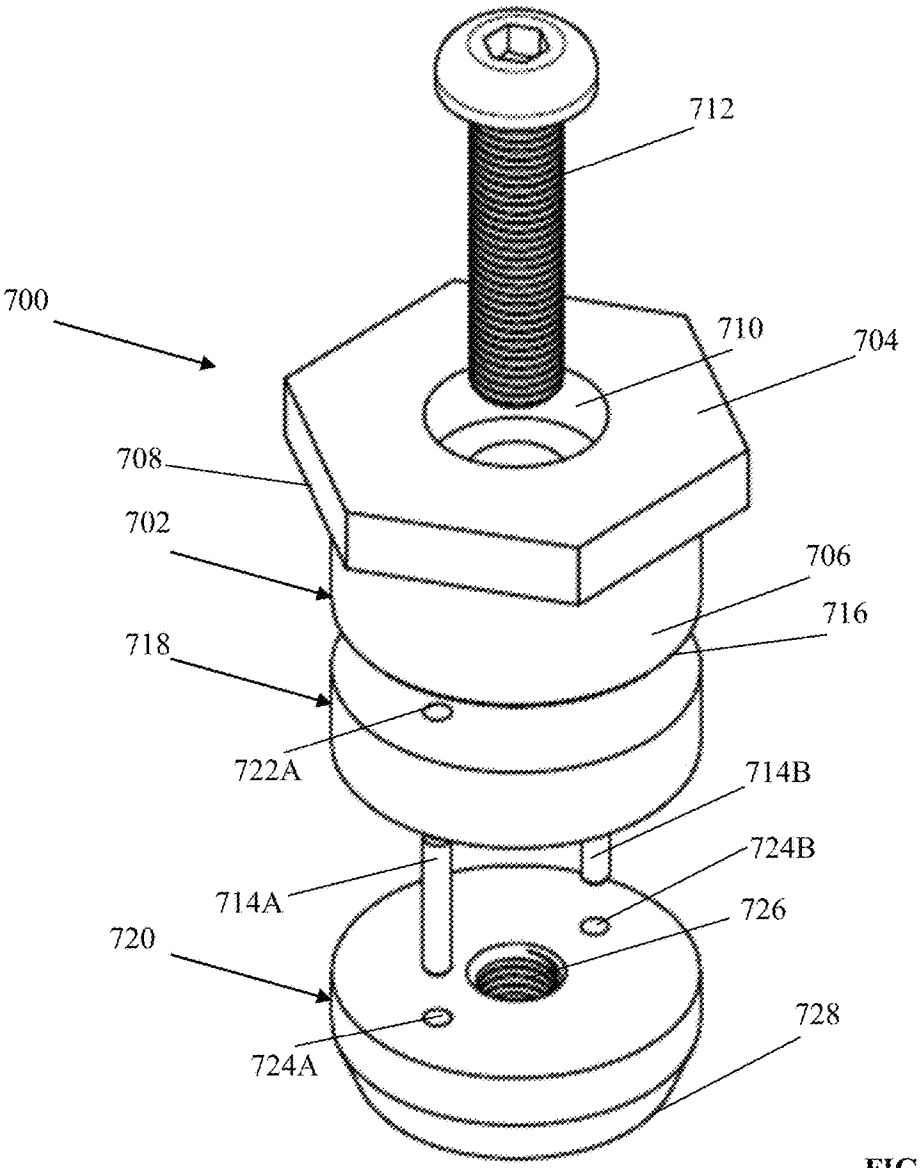
FIG. 7 is an exploded perspective view of another exemplary pile connection device in a disassembled configuration.

Referring to FIG. 7, an exploded perspective view of another exemplary pile connection device 700 in a disassembled configuration is illustrated. The pile connection device 700 in this example includes a plug 702 that includes a plug head 704, a plug body 706 that extends from a first distal end 708 of the plug head 704, and a bolt aperture 710 that extends through the plug head 704 and the plug body 706 and is configured and sized to receive a bolt 712. In this example, the plug head 704 is wider than the plug body 706, and an aperture of the sets of pile apertures 202A-B, to prevent the plug head 704 from entering the sets of pile apertures 202A-B.

The plug 702 further includes at least two pins 714A-B extending from a distal end 716 of the plug body 706. Except for the optional beveled plug body distal end 318, the plug 702, the bolt 712, and/or the pins 714A-B can be the same as the plug 302, the bolt 400, and/or the pins 316A-B described and illustrated above with reference to the pile connection device 300, including with respect to the thickness of the plug body 706 in relation to the thickness of the first and second piles 104 and 108, respectively.

The pile connection device 700 also includes a washer 718 and a nut 720, with the washer 718 configured to be disposed between the plug 702 and the nut 720. The washer 718 in this example is made of a pliable material, such as a rubber material, although the washer 718 can be made of other materials (e.g., metal) and can be a disc spring or any other type of structure capable of expanding when compressed to have a greater width and/or larger diameter. Combination of such devices and/or multiple washers can also be used in other examples. Accordingly, the washer 718 in this particular example is configured to, when compressed, deform to a shape that is wider than the plug body 706, and an aperture of the sets of pile apertures 202A-B, to thereby retain the pile connection device 700 in place within one of the sets of pile apertures 202A-B, as explained in more detail below. The washer includes at least two pin apertures 722A and 722B (not shown in FIG. 7) each of which is configured and sized to receive a portion of one of the pins 714A-B.

The nut 720 in this example includes at least two pin apertures 724A-B each of which is configured and sized to receive another portion of one of the pins 714A-B, and a bolt aperture 726 that is threaded and configured to align with the plug bolt aperture 710 when the pins 714A-B are received by the nut pin apertures 724A-B. Accordingly, the nut bolt aperture 724 is configured to receive a threaded distal portion of the bolt 712 to thereby draw the nut 720 toward the plug 702 and compress the washer 718, as explained in more detail below. The nut 720 also includes an optional beveled portion 728 disposed at a distal end of the nut 720 to aid insertion of the pile connection device 700 into one of the sets of pile apertures 202A-B. In other words, a distal end of the nut 720 is narrower in this example than a proximal end of the nut 720. Thus, except for the projections 326A-B, the nut 720 can be the same as the nut 322 described and illustrated above with reference to the pile connection device 300.

Figure 8:
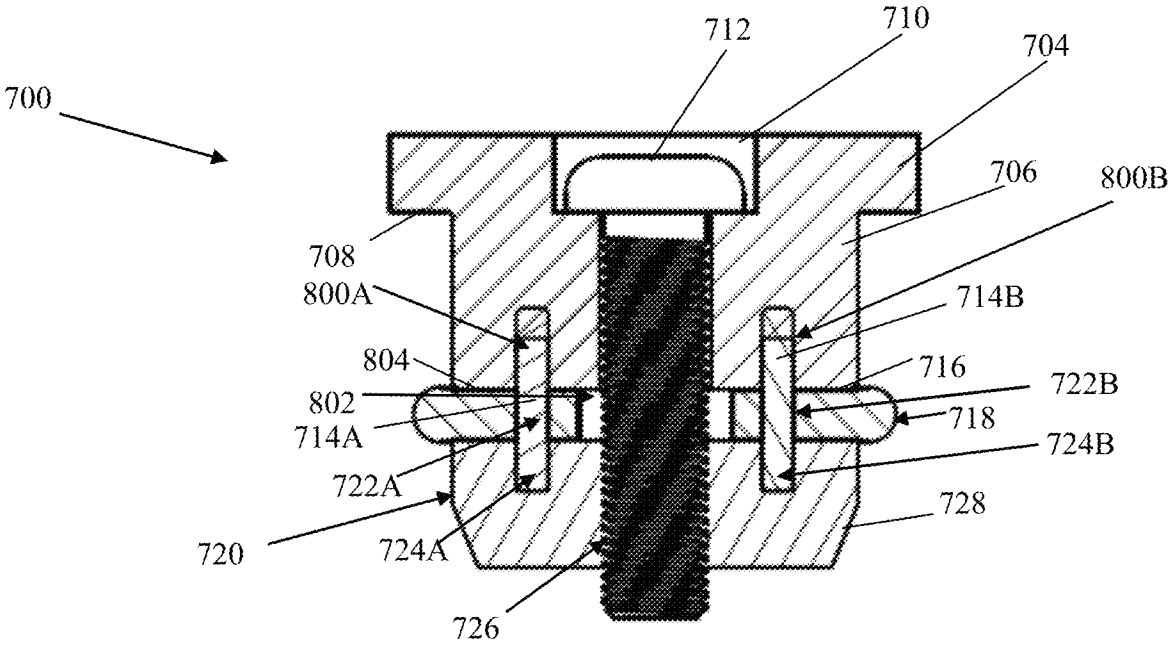
FIG. 8 is a cross-sectional view of the pile connection device of FIG. 7 in an assembled configuration but before tightening the bolt to complete installation.
Figure 9:
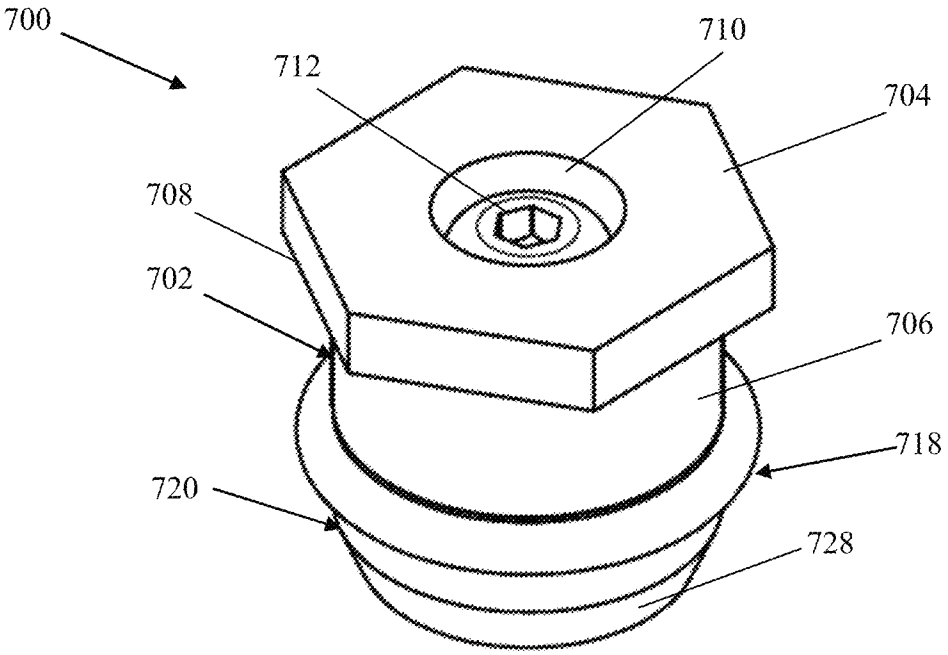
FIG. 9 is a perspective view of the pile connection device of FIG. 7 in the assembled configuration but before tightening the bolt to complete installation.

Referring to FIGS. 8-9, a cross-sectional view and a perspective view, respectively, of the pile connection device 700 in an assembled configuration but before tightening the bolt 712 to complete installation is illustrated. In this example, the pins 714A-B are press fit into cavities 800A-B, respectively, in the plug body 706, although the pins 714A-B can be attached to the plug body 706 in other ways and can also be integral with the plug 302 in other examples, as explained above.

The bolt 712 is then inserted through the plug bolt aperture 710 and another aperture 802 in the washer 718, and a threaded portion disposed toward a distal end of the bolt 712 is then threaded into the nut bolt aperture 726 with the pins 714A-B being received by the pin apertures 724A-B, respectively. The pin apertures 724A-B are illustrated in FIG. 8 as cavities, but can be holes extending through the entire length of the nut 720 in other examples. As explained above, the pins 714A-B prevent the nut 720 from rotating while the bolt 712 is received by the threaded nut aperture 726.

As illustrated in FIG. 8, the pile connection device 700 is in an assembled configuration and can be inserted into one of the sets of pile apertures 202A-B (e.g., until the plug head 704 contacts an exterior portion of the first pile 104). Subsequent to insertion into the one of the sets of pile apertures 202A-B, the bolt 712 is increasingly threaded into the nut bolt aperture 726 causing the nut 720 to be drawn toward the plug 702, and the washer 718 is thereby increasingly compressed between the nut 720 and the plug body 706.

As the washer 718 compresses, at least a portion (e.g., an exterior or outer portion around the circumference) of a proximal end 804 of the washer 718 is configured to engage an inner portion (e.g., second pile inner wall 410) of the first pile 104 to thereby retain the plug 702 within the aligned one of the sets of pile apertures 202A-B. In other words, the washer 718 is configured to compress and deform to contact the first pile 104 and prevent the nut 722, and any other portion of the pile connection device 700, from moving in a rearward direction back through the one of the sets of pile apertures 202A-B. Accordingly, when installed, the weight of an upper one of the first or second piles 104 and 108, respectively, is advantageously supported by the plug body 706 and there are no threads in the shear plane associated with the first and second piles 104 and 108, respectively.

As described and illustrated by way of the examples herein, this technology facilitates reduced installation time and effort to connect piles during construction of a deep structural foundation, for example. Additionally, the disclosed technology requires significantly less material than prior art pile connection systems, resulting in reduced cost and weight, among other advantages. Moreover, the pile connection devices 300 and 700 of this technology exhibit minimal drag and do not require any threads to be in any portion of the shear plane, resulting in increased strength and durability.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A pile connection device, comprising:

a plug comprising a plug head, a plug body extending from a first distal end of the plug head, a first bolt aperture extending through the plug head and the plug body and configured to receive a bolt, and at least two pins extending from a second distal end of the plug body, wherein the plug head is wider than the plug body; and a nut comprising at least two pin apertures each configured to receive one of the pins, a plurality of projections extending from at least a portion of a circumference of a first proximal end of the nut, and a second bolt aperture that is threaded and configured to align with the first bolt aperture when the pins are received by the pin apertures, wherein the second bolt aperture is configured to receive a threaded distal portion of the bolt to thereby draw the nut toward the plug and the pin apertures extend through the nut from a third distal end of the nut to the first proximal end of the nut between the projections and the second bolt aperture.

2. The pile connection device of claim 1, wherein the plug body is configured to be inserted into aligned first and second pile apertures in first and second piles, respectively, and has a plug body thickness that is at least as thick as a combined thickness of first and second walls of the first and second piles, respectively.

3. The pile connection device of claim 2, wherein the projections are configured to engage an inner portion of the second pile when the plug body is inserted into the aligned first and second pile apertures, the threaded distal portion of the bolt is received by the second bolt aperture, and the nut is drawn toward the plug.

4. The pile connection device of claim 1, wherein the second distal end of the plug body is beveled and the projections are configured to engage the second distal end of the plug body when the threaded distal portion of the bolt is received by the second bolt aperture and the nut is drawn toward the plug.

5. The pile connection device of claim 4, wherein one or more of the projections comprises a third proximal end that is angled to match an angle of the second distal end of the plug body such that the one or more of the projections expand outward when the one or more of the projections engage the beveled second distal end of the plug body.

6. The pile connection device of claim 1, wherein the plug body is wider than the nut and the third distal end of the nut is narrower than the first proximal end of the nut.

7. The pile connection device of claim 1, wherein the projections are spaced from each other and disposed around an entirety of the circumference of an outer portion of the first proximal end of the nut.

8. The pile connection device of claim 1, wherein the plug body further comprises at least two pin cavities disposed proximate the second distal end of the plug body and each configured to receive another portion of one of the pins via a press fit.

9. A method for connecting piles, the method comprising:

providing the pile connection device of claim 1;

inserting the pile connection device into a first pile aperture of a first pile and an aligned second pile aperture of a second pile such that a first portion of the first distal end of the plug head is disposed proximate a second portion of an outer wall of the first pile; and threading a third portion of the threaded distal portion of the bolt within the threaded second bolt aperture to thereby draw the nut toward the plug body at least until the projections contact an inner portion of the second pile.

10. The method of claim 9, further comprising repeating the providing, inserting, and threading for another pile connection device of claim 1 and aligned third and fourth pile apertures of the first and second piles, respectively, wherein the third and fourth pile apertures are in an opposing side of the first and second piles as the first and second pile apertures.

11. The method of claim 9, further comprising, prior to inserting the pile connection device, inserting the pins into the pin apertures.

12. The method of claim 9, further comprising, prior to inserting the pile connection device, threading a fourth portion of the threaded distal portion of the bolt into the threaded second bolt aperture, wherein the fourth portion of the threaded distal portion of the bolt is disposed further toward a fourth distal end of the second bolt than the third portion of the threaded distal portion of the bolt.

13. The method of claim 9, further comprising, prior to inserting the pile connection device, pressing a fourth portion of each of the pins into respective pin cavities disposed proximate the second distal end of the plug body.

14. The method of claim 9, further comprising threading the third portion of the threaded distal portion of the bolt within the threaded second bolt aperture until the first proximal end of the nut contacts the second distal end of the plug body.

15. The pile connection device of claim 1, wherein the plug body further comprises a beveled portion disposed toward the second distal end of the plug body and each of the pins extend from the second distal end of the plug body between opposing sides of the beveled portion.

16. The pile connection device of claim 1, wherein each of the pins is substantially cylindrical in shape and configured to be slidably received by a fourth distal end of one of the pin apertures.

17. A method for connecting piles, the method comprising:

providing a pile connection device comprising:

a plug comprising a plug head, a plug body extending from a first distal end of the plug head, a first bolt aperture extending through the plug head and the plug body and configured to receive a bolt, and at least two pins extending from a second distal end of the plug body, wherein the plug head is wider than the plug body; and a nut comprising at least two pin apertures each configured to receive one of the pins, a plurality of projections extending from at least a portion of a circumference of a first proximal end of the nut, and a second bolt aperture that is threaded and configured to align with the first bolt aperture when the pins are received by the pin apertures, wherein the second bolt aperture is configured to receive a threaded distal portion of the bolt;

inserting the pile connection device into a first pile aperture of a first pile and an aligned second pile aperture of a second pile such that a first portion of the first distal end of the plug head is disposed proximate a second portion of an outer wall of the first pile; and threading a third portion of the threaded distal portion of the bolt within the threaded second bolt aperture to thereby draw the nut toward the plug body at least until the projections contact an inner portion of the second pile.

* * * * *